United States Patent [19]

Yanna

[11] 4,296,883

[45] Oct. 27, 1981

[54] HEAT GENERATION AND DISTRIBUTION SYSTEM

[76] Inventor: Andrew F. Yanna, 4389 Jean Rd., Bay City, Mich. 48706

[21] Appl. No.: 40,457

[22] Filed: May 18, 1979

[51] Int. Cl.[3] ..... F24D 3/00

[52] U.S. Cl. ..... 237/59; 237/66; 237/56

[58] Field of Search ..... 237/59, 56, 60, 66, 237/8 R; 165/106; 126/434

[56] References Cited

U.S. PATENT DOCUMENTS

| | | | |
|---|---|---|---|
| 10,923 | 4/1888 | Prall | 237/12.1 |
| 210,563 | 12/1978 | Salmon | 237/67 |
| 352,908 | 11/1886 | Barker | 237/66 |
| 3,515,345 | 6/1970 | Barnd | 237/8 R |

*Primary Examiner*—Albert J. Makay
*Assistant Examiner*—Henry Bennett
*Attorney, Agent, or Firm*—Harvey B. Jacobson

[57] ABSTRACT

A heat distribution system is disclosed for transferring heat, such as is generated by a burner device of conventional construction, to a remote location, with circulation away from the burner in a horizontal or downward direction. The distribution system of the invention is particularly useful whenever a building heating arrangement requires the furnace or other equivalent heating means to be located above or level with the point at which heat is to be withdrawn from a circulating fluid.

7 Claims, 5 Drawing Figures

HEAT GENERATION AND DISTRIBUTION SYSTEM

BACKGROUND OF THE INVENTION

1. Field of the Invention

The invention relates to distribution systems for dissemination of heat. More specifically, the invention contemplates a closed system containing a liquid wherein the system includes a heat generating unit comprising a conventional burner and a generating tank, in which the liquid is heated, connected sequentially to a radiator tank in association with a blower unit, a return tank, a vacuum tank, a supply tank, and the generating tank. When operated according to the present invention, flow of liquid occurs from the generating tank to the radiator tank, even when the radiator tank is level with or below the level of the generating tank. No mechanical pumping means is provided at any point in the system.

2. Disclosure Statement

In U.S. Pat. No. 3,450,346, issued June 17, 1969, Bilinski discloses a space heater with conduit means which transmit a heated fluid generally horizontally from a heater to a radiator, and Kennedy in U.S. Pat. No. 3,523,180, patented Aug. 4, 1970, discloses a space heater made from a heating tube and radiator tube, with an expansion tube located above the radiator tube. Both the Bilinski and Kennedy devices provide for continued circulation without provision of mechanical pumping means, as does Barbier in U.S. Pat. No. 3,469,075, issued Sept. 23, 1969. Knipper in U.S. Pat. No. 2,146,148, issued Feb. 7, 1939, shows a heating system with a radiator maintained at the same level as a heater, with no provision of mechanical pumping means. In U.S. Pat. No. 2,025,695, issued Dec. 24, 1935, Stewart discloses a heating system with the heater above the level of the radiators, while Rouquaud in U.S. Pat. No. 1,118,285, patented Nov. 7, 1911, shows a system for hot water circulation having an open tank for holding a supply of liquid.

Moreover, Powers in U.S. Pat. No. 2,539,469, issued Jan. 30, 1951, shows a domestic hot water system comprising a fluid circulating loop through which fluid apparently circulates by thermosiphonic action, with no external pumping means present. Mills in U.S. Pat. No. 579,070, patented Mar. 16, 1897, discloses a system for heat distribution wherein the natural upward flow of hot liquid provides circulation without external pumping means, and Salmon in U.S. Pat. No. 210,563, patented Dec. 3, 1878, discloses a hot water heating system for cyclical operation, one step of which involves forming a vacuum in the upper tank by condensation of steam.

Other patents of possible pertinence to the subject matter of the disclosed invention include the following:

| | | |
|---|---|---|
| 834,735 | H. V. Jorgensen et al | Oct. 30, 1906 |
| 862,642 | H. V. Jorgensen | Aug. 6, 1907 |
| 875,107 | A. B. Reck | Dec. 31, 1907 |
| 1,101,330 | A. B. Reck | June 23, 1914 |
| 1,965,727 | F. Springuel | July 10, 1934 |
| 2,068,549 | D. B. Knight | Jan. 19, 1937 |
| 2,692,732 | N. L. Lieberman | Oct. 26, 1954 |
| 2,952,410 | M. B. MacKay | Sept. 13, 1960 |

Many prior approaches to circulation of a heated fluid for delivery of the heat content thereof have involved provision of mechanical pumping means, a procedure which is expensive, requires considerable maintenance, and failure of such pumping means can cause disruption of service, including possible freezing of lines when a circulating fluid such as water is used in a building during periods of subfreezing temperatures. Many other previous approaches to circulation of heated fluids without provision of mechanical pumping means have relied upon well-known principles of thermosiphonic action, whereby a liquid heated in a vessel forming part of a closed system rises upwardly in a direction forming the smallest angle with the vertical, while incoming liquid enters the heating zone from the direction furthest from the vertical, such as in an inlet entering from the level or from the below. Such systems are adapted to uses in which the heating system can be located below the position of intended use of heat delivered, but are not adaptable for use where a radiator, for example, is provided below or on the same level as the heating device.

SUMMARY OF THE INVENTION

Accordingly, it is an object of the present invention to provide a closed system for delivery of heat in a substantially horizontal or downward direction, while incoming liquid is introduced from above into a generating vessel forming a part of a closed loop heating system, wherein the liquid is heated from an external source of heat.

Another object of the invention is to provide such a system without requiring mechanical pumping means at any location.

Still another object is to provide a system in which the generating tank and source of external heat are isolated from the remainder of the system.

Still another object is to provide a radiator for the system in which the radiator is provided with an air blower for facilitating transfer of heated air therefrom, and the blower and radiator are isolated from the remainder of the system and located in a space to be heated.

A further object is to provide a system whose liquid medium can be replenished as needed.

Still a further object is to provide a system which continues to operate in the desired manner, so long as heat is applied to the generating tank, without provision of mechanical pumping means in the system.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
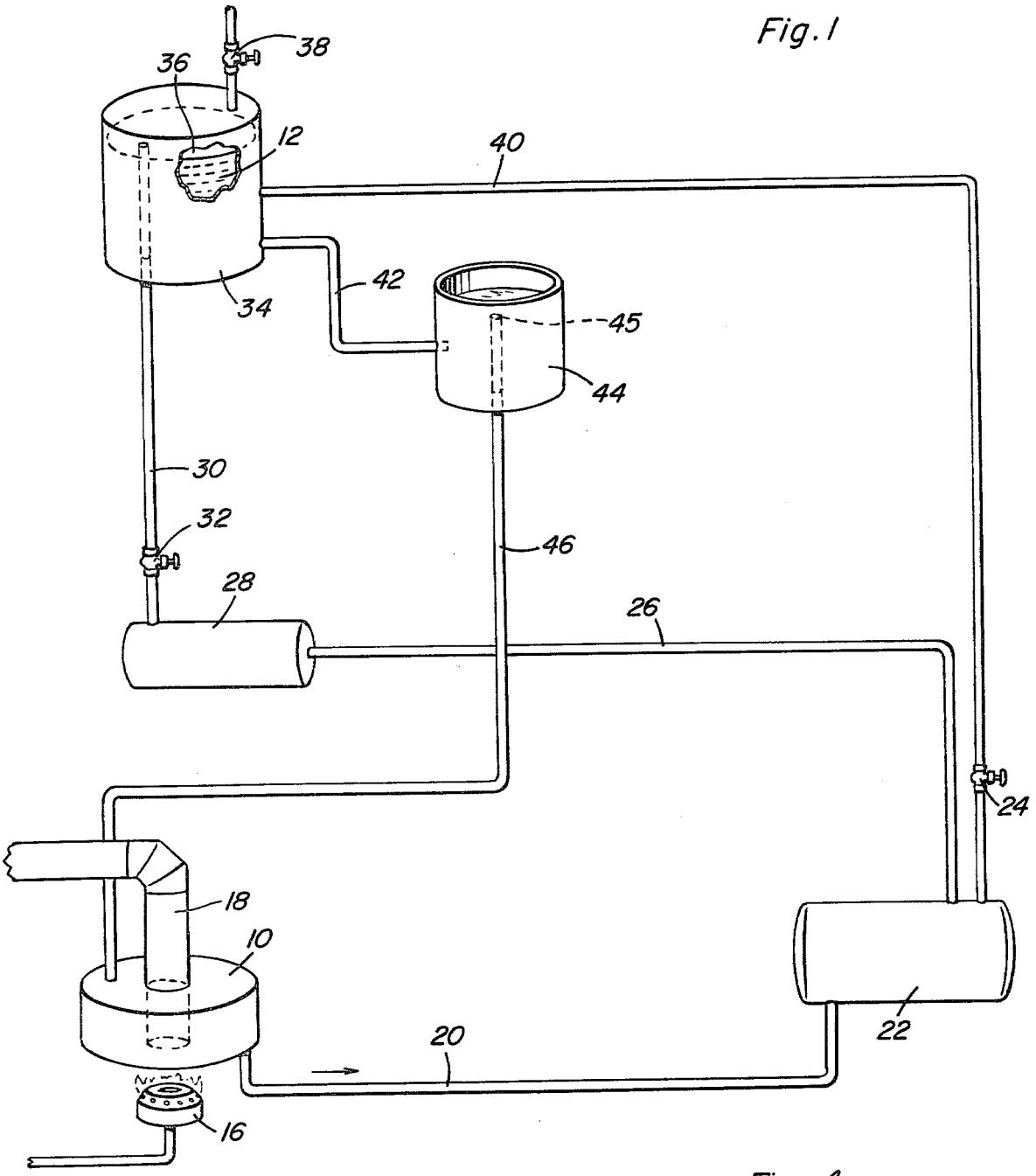
FIG. 1 shows a heat distribution system according to one form of the invention, as described in Example I, in which a tank represents the heat withdrawal means.

It is the unexpected finding that with the system of the present invention a heat transfer liquid contained within a closed system can be circulated continuously without provision of a mechanical pumping means in a direction in which heated liquid flows in a substantially horizontal or downward direction to a heat withdrawal, radiator, or blower means. After the flow of heat transfer liquid is established in the desired direction, circulation continues without provision of additional mechanical pumping means. In the first embodiment of the invention, shown in FIGS. 1 and 2, the system comprises generating tank 10, filled with heat transfer liquid 12, which fills the entire closed system. Generating tank 10 is provided with a central through hole 14 to facilitate passage of hot gases from burner 16 upwardly through generating tank 10, after which the gases are vented through pipe 18. Heated liquid travels in the direction of the arrow from generating tank 10 through line 20 and enters radiator tank 22, where heat is removed from the liquid at a desired rate. Valve 24 is ordinarily closed in normal operation of the system. Heat transfer liquid from radiator tank 22 passes through line 26 into return tank 28, and thence through line 30, valve 32 ordinarily remaining in the open position during operation of the system, liquid then entering vacuum tank 34. Line 30 projects upwardly into vacuum tank 34 to discharge heat transfer liquid near the top of vacuum tank 34, as seen in dotted lines in FIG. 1. Heat transfer liquid 12 can be seen in vacuum tank 34 in FIG. 1 in broken away portion thereof, vacuum tank 34 having above the liquid level a space 36 ordinarily maintained under a partial vacuum. Valve 38, which is ordinarily kept in the closed position, can be connected to a vacuum pump for evacuating the space above liquid 12 in order to begin operation of the system. Inasmuch as valve 24 is ordinarily closed during operation of the system, line 40 is not available for transport of liquid 12 in vacuum tank 34. Accordingly, liquid flows from vacuum tank 34 through line 42 into supply tank 44, which is open to the atmosphere. Since cooling of liquid 12 occurs in radiator tank 22, return tank 28, vacuum tank 34, and supply tank 44, as well as in the connecting lines, liquid returning to generating tank 10 through line 46 from supply tank 44 will be the coolest of any point in the system.

Figure 2:
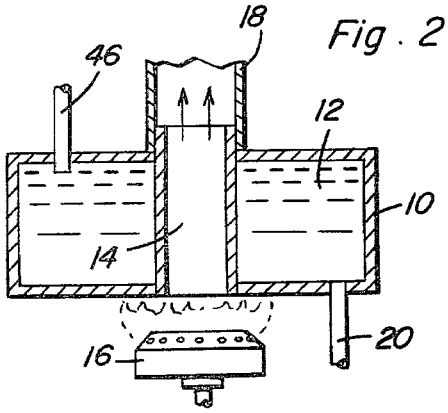
FIG. 2 is a sectional view of one possible form of the generating tank, showing in addition the associated burner for introducing heat into liquid contained in the generating tank.
Figure 4:
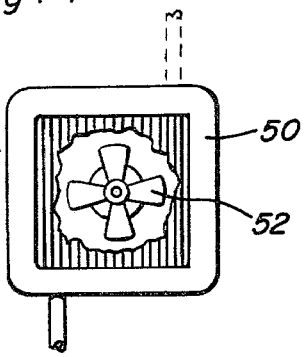
FIG. 4 is a side elevational view of a radiator, partly broken away to show blower means for facilitating withdrawal of heat from the radiator.

It is to be noted from FIG. 1 that radiator tank 22 is located substantially at the same level as generating tank 10. Although it might be expected that warmed heat transfer liquid would rise from generating tank 10 through line 46 to supply tank 44, due to thermosiphonic action as is well known in the art, it has been found that the opposite occurs when circulation is initiated in the opposite direction. Warmed heat transfer liquid 12 passes downwardly into line 20, and thence to radiator tank 22, and continuous circulation is maintained in such direction so long as burner 16 continues to supply heat to generating tank 10. Accordingly, particularly when radiator tank 22 is replaced with blower 50, best seen in FIG. 4, efficient heat transfer and withdrawal from the system is possible, even where a burner or equivalent heat source, such as a furnace, is located at a level substantially the same as or above the radiator. Such a situation can occur, for example, when a basement or sub-basement is to be heated by a furnace located at the same level or above the space to be heated. In this regard, it is important to note that the most efficient heating of air in a space to be heated occurs when the heated air is delivered near the lower part of the room or space to be heated, inasmuch as conductive mixing is promoted as the warm air rises in the space being warmed.

Since circulation of heat transfer fluid occurs in the system of FIG. 1 without provision of mechanical pumping means to impel the fluid through the system, no source of electrical energy is required. Accordingly, the system of FIG. 1 is usable in remote locations, such as those at which electrical power is unavailable. Moreover, when blower 50 is substituted for radiator tank 22, the only required power is that necessary to operate circulating fan 52. Fan 52 can be activated by a thermostat control system and blower 50 can be located at any desired location. Inasmuch as the system of FIG. 1 requires no pump, and can be operated with city gas, bottled gas, or fuel oil, the system is particularly adaptable for use in remote locations where bottled gas or fuel oil is deliverable but where electrical power is unavailable. Moreover, the system possesses portability which affords the opportunity to assembly a system for distribution of heat according to the invention wherever needed, such as locations such as remote construction sites, locations of natural disasters, and emergency heating systems for use in hospitals, schools, or the like, when conventional utilities are inoperative. Such temporary or emergency uses are facilitated by the compactness of a unit embodying the system of the invention, and utility is furthered by housing the components of the system in a neatly arranged package.

Figure 3:
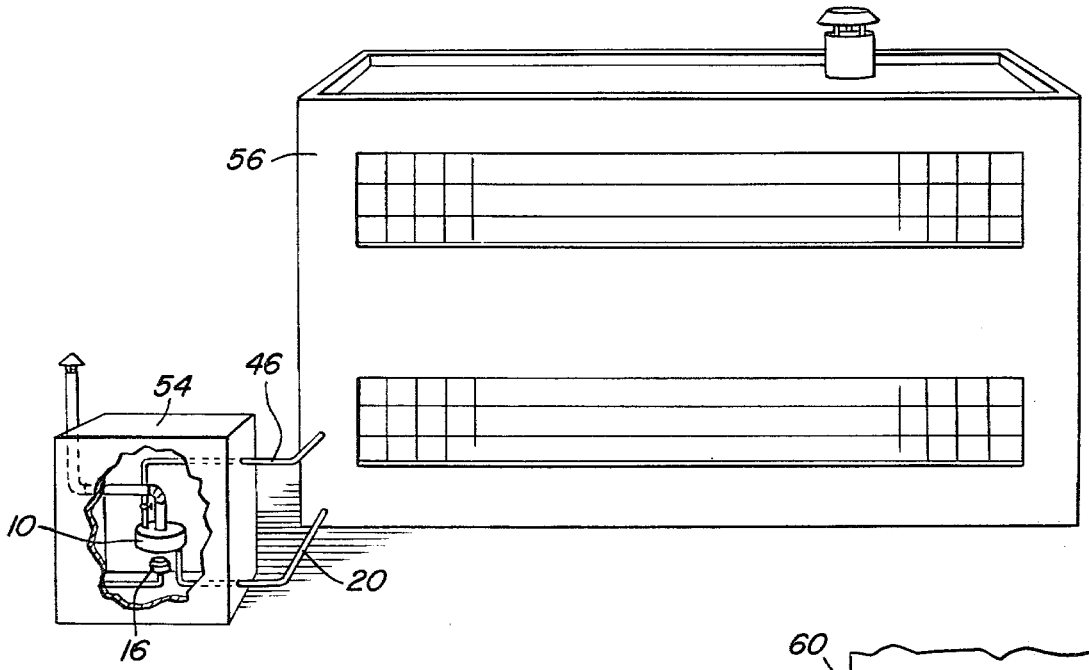
FIG. 3 is a perspective view of a form of the invention wherein the generating tank and burner are housed in a detached enclosure, while the remainder of the heat distribution system is contained within a building.

In a particularly useful arrangement for the present invention, the generating tank and burner are separately enclosed for reasons of safety and convenience. Generating tank 10 and burner assembly 16 are housed in detached enclosure 54 in FIG. 3, while remaining portions of the heating system, including a radiator tank or blower assembly, a return tank, a vacuum tank, and a supply tank, are housed within building 56 containing a space which is to be heated by transfer of heat from burner 16 through line 20, with return cooled heat transfer liquid back to generating tank 10 through line 46. Building 56 can be any conventional structure such as a factory, warehouse, apartment building, residential structure, or the like.

Figure 5:
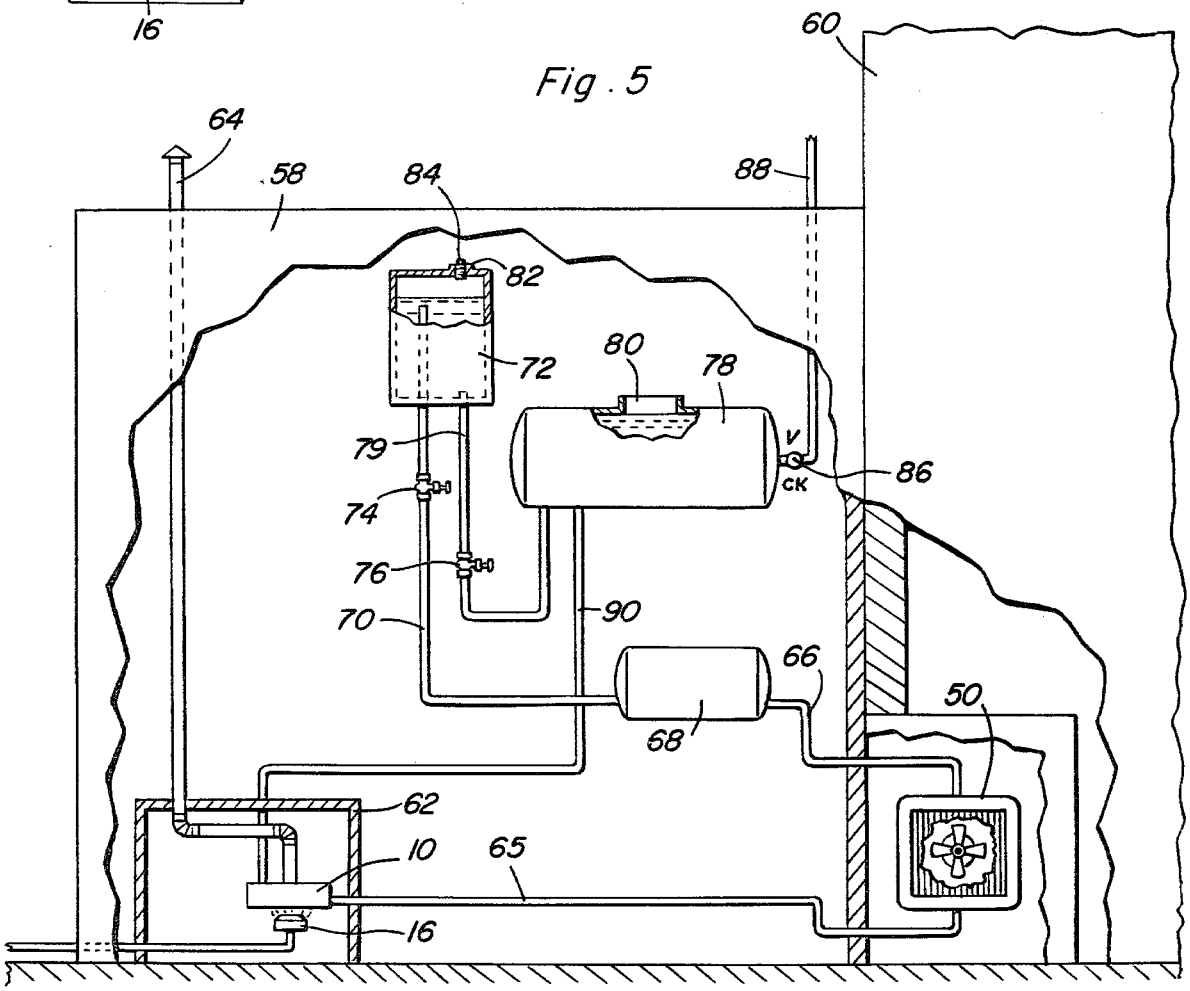
FIG. 5 is a schematic view of a second form of the invention, wherein the radiator is housed in a building to be heated, while the remainder of the invention is contained within a semi-detached enclosure adjacent the building.

A second form of the invention is shown in FIG. 5, where the entire system is contained within semi-detached enclosure 58 adjacent building 60, except for blower 50 for heating of the space within building 60. In addition, generating tank 10 and burner 16 are enclosed for safety reasons in compartment 62. Vent 64 serves to carry away combustion gases from the flame emanating from burner 16. In the embodiment of FIG. 5, heated fluid from generating tank 10 flows through line 65 to blower 50, then upwardly through line 66 to return tank 68, and then through line 70 to vacuum tank 72. Ordinarily, valve 74 is open during operation of the device. Valve 76 in line 79 is also open, permitting flow from vacuum tank 72 to supply tank 78. Supply tank 78 has port 80 which is open to atmospheric pressure. Vacuum tank 72 is also provided with port 82 but port 82 is ordinarily sealed in an airtight fashion by plug 84. Non-return valve 86 in fill line 88 permits filling of supply tank 78 from line 88, without leakage from supply 78 in a reverse direction. From supply 78, liquid flows through line 90 back to generating tank 10, where the process is repeated to give continuous operation without any requirement for mechanical pumping means.

Although not illustrated in FIGS. 1 or 5, the supply tanks, vacuum tanks, and return tanks, as well as all connecting lines, can be covered with an insulating material to prevent or substantially reduce heat flow into ambient surroundings, in a manner well known in the art.

It is further to be noted that, in order to initiate operation of the system, it may be necessary to apply by external pressure generating means an initial flow in the direction of the arrow in FIG. 1. This can be effected by first raising the temperature of fluid in generating tank 10 by momentary operation of burner 16, and then forcing downwardly a flow of liquid through line 46 to initiate movement of heated liquid through line 20 into radiator tank 42. With continued operation of burner 16, flow in the desired direction can be maintained even after the initiating flow ceases. As is readily apparent from FIG. 1, a convenient method for initiating the stated flow is by first filling the entire system with water, closing valves 32, 24 and 38, insuring that the level of liquid in supply tank 44 is above the upper end 45 of line 46, which extends upwardly into supply tank 44, and then heating generating tank 10, followed by opening of valve 32 to permit flow by gravity through line 46 from supply tank 44. As operation proceeds, valves 38 and 24 are ordinarily left closed and valve 32 remains open. To shut down operation, valve 32 is closed and burner 16 shut off. Valves 38 and 24 can be opened to assist in draining heat-transfer fluid 12 from the system whenever necessary, such as during cleaning operations, disconnection of the system, or the like.

When operated in the manner disclosed, the device requires no mechanical pump and can be operated economically with city gas, bottled gas, or fuel oil. A major reason that operation is economical resides in the fact that heat transfer liquid is constantly flowing at all times and the only requirement for electric power occurs when demand for heat through radiator tank 22 or blower 50 is triggered, such as by a thermostat in building 56, building 60, or the region surrounding radiator tank 22. Moreover, it has been found that a relatively small flame from burner 16 is required to heat a substantial volume of fluid, which is flowing at all times.

Preferably, the heat transfer liquid which is used in either embodiment of the invention is water, although other liquids can also be used. Inasmuch as water has a relatively high heat capacity and is the least costly liquid available, while possessing relatively few drawbacks in the situation wherein mechanical pumping is absent, water is the preferred fluid for use with the invention. Deposits on interior surfaces of tanks and connecting lines can be eliminated or minimized by use of well-known additives, and corrosion can be minimized by addition of a suitable conventional anti-corrosion composition or by provision of non-corrodible tanks and lines, such as stainless steel or the like.

It is to be understood that non-return valve 86 is optional in the embodiment of FIG. 5, its purpose being to replace any heat transfer liquid which could be lost by evaporation. Any other suitable means for signalling a need for replenishing such evaporated liquid in the system, such as indicating means to enable an operator to add fluid, float valve means for controlling the level of liquid in tanks 44 and 48, or the like, could also be employed.

EXAMPLE I

A model of the system shown in FIG. 1 was constructed from steel tanks connected by copper tubing substantially as shown in FIG. 1. Valve 24 was closed, the system was filled with liquid in the manner illustrated in FIG. 1, and valves 38 and 32 were closed. A milky appearing aqueous suspension in order to render movement of the liquid in tank 44 visible, and in order to inhibit corrosion of steel components. The five tanks comprising the system each had approximate capacities of several cubic centimeters, and the overall distance separating the highest point from the lowest point in the system was a few tens of centimeters. Burner 16 was a hand-held portable torch attached to a propane cylinder, and was operated at substantially maximum capacity to heat generator tank 10. Supply tank 44 was filled above the level of opening 45 and valve 32 was opened after substantial heating of water in generator tank 10 had proceeded, but before the temperature of water in generator tank 10 had reached the boiling point. Flow from supply tank into line 46, and thence into generating tank 10, once initiated, proceeded continuously as long as burner 16 continued in operation heating generator tank 10.

The model demonstrated the feasibility of the system to cause flow in the direction of the arrow in FIG. 1 instead of the direction of generating tank 10 to supply tank 44, located above generating tank 10.

EXAMPLE II

In a working arrangement scaled up from the model of Example I, constructed substantially according to the system of FIG. 5, operation of the system was achieved in the manner taught herein. After continuous operation was achieved, temperatures of the water in radiator unit 50, reservoir tank 68, and supply tank 78 were measured, with the results of the following Table:

TABLE

| Location of Measurement | Temperature |
|---|---|
| Radiator unit or blower 50 | 182° F. |
| Return tank 68 | 178° F. |
| Supply tank 78 | 162° F. |

Statements concerning component relative temperatures are confirmed by the data of Example II. Further, usefulness of the invention on the scale required for room heating is demonstrated by the test described in Example II.

Accordingly, circulation to radiator tank occurs in a manner which permits withdrawal of heat from radiator tank 22 in a continuous fashion, the speed of circulation being governable by the degree of opening of valve 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a heat source, a closed heat distribution system for delivery of heat from the heat source to a location of use for dissipation of heat below or level with the heat source wherein the system contains a liquid heat transfer medium, a generating tank adjacent said heat source and containing said liquid medium for absorption of heat by the liquid medium, radiator means for withdrawal of heat from the liquid medium and delivery of heat to the location of use, the radiator means being located in a horizontal or downwardly sloping run from said generating tank and being connected thereby to the generating tank, a return tank connected to the radiator means for receiving the output of liquid medium from the radiator means, a vacuum tank for receiving the output of liquid medium from the return tank, said vacuum tank having a vacuum space adjacent the tanktop, said output being received within the vacuum space and a supply tank for receiving the output of liquid medium from the vacuum tank and for feeding liquid medium to the generating tank, said supply tank being connected to the generating tank by a connecting line which extends upwardly into the supply tank and has an opening within the space defined inside the supply tank, said supply tank being open to ambient surroundings and being connected to the vacuum tank by a downwardly sloping traverse pipe from adjacent the bottom of said vacuum tank, said vacuum tank being located above said return tank and supply tank and is enclosed, having covering means provided with a valve for selectively admitting air from the ambient surroundings to the interior of the vacuum tank, said generating tank, said radiator means and said return tank being closed and sequentially connected, the return tank being higher in elevation than the generating tank and radiator means, the distribution system being operable continuously through application of heat from the heat source to the generating tank without use of any mechanical pumping means.

2. The system of claim 1 including valve means for regulating flow in said system of liquid heat transfer medium, and for terminating the flow to inactivate the system.

3. The system of claim 2 wherein said valve means is located between the return tank and the vacuum tank.

4. The system of claim 3 wherein said radiator means includes a heat exchange surface and a blower for transfer of heat from the surface to air forced into heat exchange contact against the surface by the blower.

5. The system of claim 4 wherein the generating tank is a cylindrical vessel having its circular periphery in a horizontal plane and having a centrally disposed substantially vertical through hole centered on the vertical axis of the cylindrical vessel, the heat source being a burner located below the generating tank so as to permit gaseous heated combustion products to pass upwardly through the through hole in the generating vessel and facilitate heat transfer therethrough into the liquid medium.

6. The system of claim 1 wherein said generating tank and heat source are enclosed in a structure having a connecting line from the generating tank within the structure to a building to be heated by transfer of heat from the radiator means, a connecting line from the supply tank to the generating tank crossing from the building to the enclosing structure, whereby safety is promoted by isolation of the burner and generating tank from the building.

7. The system of claim 1 wherein the radiator tank is a blower, the blower being located within a blower enclosure inside a building to be heated, the remainder of the system being enclosed within a system enclosure, the heat source and generating tank being located within a heater enclosure in said system enclosure, whereby components of said system are compartmentalized for safety and conservation of heat.

* * * * *